United States Patent [19]

Odenthal

[11] Patent Number: 4,915,247

[45] Date of Patent: Apr. 10, 1990

[54] PACKING FOR PACKAGED GOODS STACKED OR PROVIDED WITH STRAIGHT EDGES

[75] Inventor: Heinz F. Odenthal, Zülpich, Fed. Rep. of Germany

[73] Assignee: Ostma Maschinenbau GmbH, Zulpich, Fed. Rep. of Germany

[21] Appl. No.: 240,255

[22] Filed: Sep. 2, 1988

[30] Foreign Application Priority Data

Oct. 29, 1987 [DE] Fed. Rep. of Germany ..... 8714373

[51] Int. Cl.[4] ..... B65D 6/00

[52] U.S. Cl. ..... 220/4 F; 206/586; 206/453

[58] Field of Search ..... 220/4 R, 4 F; 206/586, 206/453; 312/257 SM

[56] References Cited

U.S. PATENT DOCUMENTS

| | | | |
|---|---|---|---|
| 2,160,221 | 5/1939 | Masters et al. | 206/586 |
| 2,250,491 | 7/1941 | Lurrain | 206/586 |
| 3,433,354 | 3/1969 | Liebel | 206/586 |
| 3,655,112 | 4/1972 | Jeffers | 206/586 |
| 3,864,636 | 8/1972 | Rothrock, Jr. et al. | 206/386 |
| 3,980,221 | 9/1976 | Okada | 206/586 |
| 4,162,729 | 7/1979 | Kaiser et al. | 206/586 |
| 4,212,394 | 7/1980 | Alley | 206/586 |
| 4,244,471 | 1/1981 | Plante | 206/586 |
| 4,583,639 | 4/1986 | Fedick et al. | 206/586 |
| 4,714,163 | 12/1987 | Reeves | 206/586 |

*Primary Examiner*—Joseph Man-Fu Moy

*Attorney, Agent, or Firm*—Herbert Dubno

[57] ABSTRACT

The packing for packaged goods stacked or provided with straight edges has a plurality of packing pieces made of packing material bent or folded in the vicinity of the edges of the packaged goods. The packing pieces have packing bars with an angular transverse cross section which are juxtaposed with and receive the edges of the packaged goods. The packing bars are assembled into a supporting framework with at least one open frame area in contrast to the solid panels used previously.

6 Claims, 3 Drawing Sheets

PACKING FOR PACKAGED GOODS STACKED OR PROVIDED WITH STRAIGHT EDGES

FIELD OF THE INVENTION

My present invention relates to a packing for a packaged good or goods stacked with linear or straight edges or having straight edges. More particularly, the invention relates to an edge protector for packaging purposes and to packaging incorporating same.

BACKGROUND OF THE INVENTION

Conventional packing for packaged goods stacked or provided with straight edges can comprise a plurality of packing pieces made of packing material bent or folded in the vicinity of the edges of the packaged good.

By "packing material" I mean packing paper, packing paperboard or cardboard and also plastic material, especially for special packing pieces, all of which can absorb blows and protect the edges of the packed stack or goods.

The packing pieces are glued together for example. They can also be attached together by sewing with mechanical wire stitching. A packing of this kind and purpose must satisfy the requirements determined by the packaged goods in regard to strength, rigidity and stability. The structure of this packing is of course subject to the laws of statics.

In the known packing the packing pieces are plate-like or panel like pieces with bent or angular regions. They form a case and/or surface supporting structure in the static sense. That requires a considerable expenditure for materials for the panel-like pieces but is also expensive in regard to engineering because full-surface blank pieces with the required folds which have a large cross section must be made and held in place. That is also true for the complete packing or package. When the packing should be provided with markings or a sign, the printing expense is large because of the large surface area of the blank piece or packing.

OBJECTS OF THE INVENTION

It is an object of my invention to provide an improved packing for packaged goods stacked or provided with straight edges which has none of the above mentioned disadvantages or difficulties.

It is also an object of my invention to provide an improved packing for packaged goods stacked or provided with straight edges having a reduced assembly and material cost.

SUMMARY OF THE INVENTION

These objects and others which will become more readily apparent hereinafter are attained in accordance with my invention in a packing for packaged goods stacked or provided with straight edges comprising a plurality of packing pieces made of packing material bent or folded in the vicinity of the edges of the packaged goods.

According to my invention the packing pieces comprise packing bars which have an angular transverse cross section and are juxtaposed with and receive the edges of the packaged goods. The packing bars are assembled into a supporting framework with at least one open frame area.

The use of a supporting framework rather than a box like case is based on the laws of statics. My invention is based on the recognition that a packing which satisfies all requirements in regard to strength, rigidity and stability can be constructed with comparatively little material expense as a supporting framework. The frame bars can be made simply and do not require large area blank pieces.

In one advantageous embodiment of my invention which is characterized by a special simplicity, the packing bars are assembled in a more or less planar framework which can be used as a tray packing without a base. In another embodiment which satisfies different requirements for different applications, the packing bars are assembled in a three-dimensional supporting framework. In this form the packing can be used as a complete package. An upper frame portion can be put on the framework as a cover and can be provided with suitable connecting or attaching elements. In both cases the usual wrapping of the packaged goods can also be applied.

In many applications the packaged goods can be packed using the packing of the above described structure according to my invention and further features or steps are not required. However when there is a danger that the packaged goods or pieces of the packaged goods may fall out from the packing made from the supporting framework, according to an additional feature of my invention, the open area and/or the open areas of the supporting framework can be covered by at least one packing panel.

When especially large loads must be absorbed because the packaged goods of course are very heavy but have only a small volume, the supporting framework can be reinforced by stabilizing pieces which are connected to the packing bars. By "stabilizing piece" I mean a packing panel, a corner cap or the like.

With the packing according to my invention the packing bars can have at least one adhesively attached web in the vicinity of the supporting frame corners and are attached to each other by adhesive.

It is also possible to attach the frame bars to each other in the vicinity of the frame corners by corner caps put on the framework. Furthermore for extreme loads both the gluing of the packing rods in the vicinity of the frame corners and the mounting of corner caps can be utilized. One can glue the previously mentioned packing panels on the supporting framework, for example by gluing to the flanges of the angular-section packing rods. Hence, an additional reinforcement is attained.

However the packing panels already provide reinforcement by being glued to the supporting framework. It should be understood that the packing panels are not very resistant to bending and that the packing bars attain their stiffness by the bending or folding. Thus they make a folded framework. Also the packing bars formed as blank pieces are comparatively easily bent or folded.

In regard to materials, the invention teaches that the packing bars are made of paper blanks or cardboard or paperboard blanks which are folded in an angular transverse cross section. The packing bars can however be made from a plastic material and can be extruded. The packing panels are advantageously constructed as paper blanks or paperboard or cardboard blanks.

The packing can be provided with code markings or sighs. Thus considerable printing expense is no longer required since the individual packing rods and/or packing panels and/or stabilizing pieces can be constructed as code marking or sign carrying elements. These small parts can be easily printed with a simple press. It is generally sufficient to print a code or sign on one of the pieces of packing.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
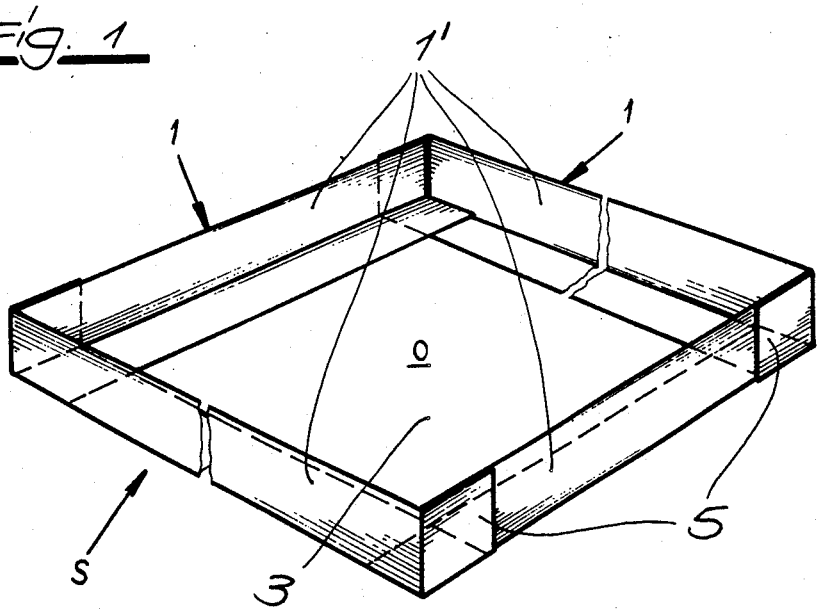
FIG. 1 is a perspective view of one embodiment of a packing frame according to my invention.

The packing shown in the drawing is designed for packaged goods P stacked or provided with straight edges. This packing basically comprises a plurality of packing pieces 1, 2 made of packing material bent or folded in the vicinity of the edges of the packaged goods.

Figure 2:
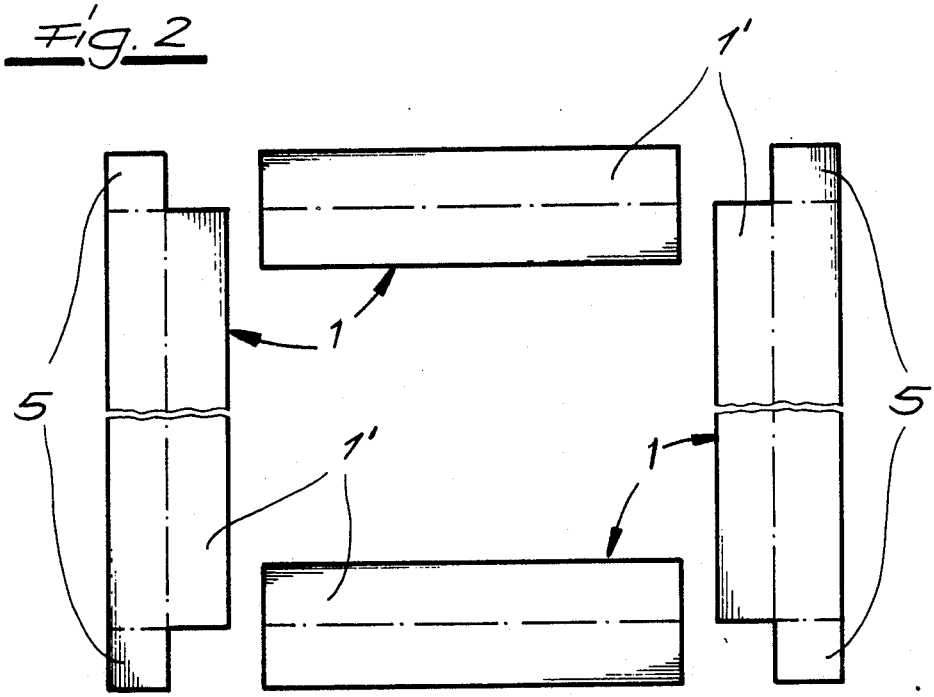
FIG. 2 is a top exploded view of the packing frame shown in FIG. 1 showing the individual packing pieces.

FIGS. 1 and 2 show that the packing pieces 1 are essentially packing bars 1' which have an angular transverse cross section and are juxtaposed with and receive the edges $E_P$ of the packaged goods P.

The packaged goods P have not been shown in FIGS. 1 to 4.

Figure 3:
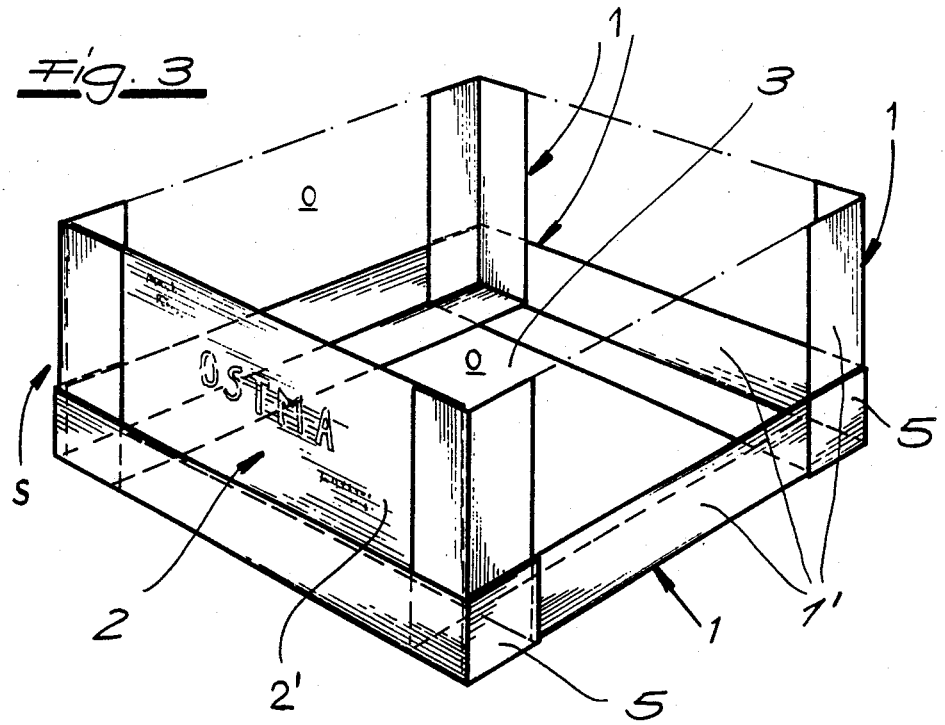
FIG. 3 is a perspective view of another embodiment of a packing according to my invention.
Figure 4:
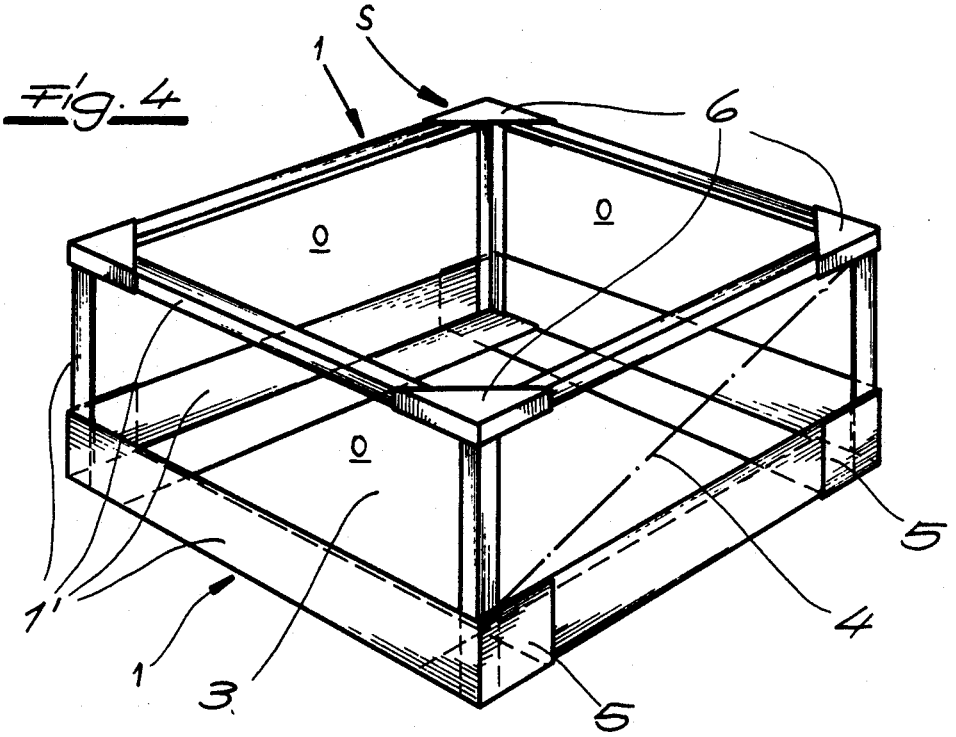
FIG. 4 is a perspective view of an additional embodiment of a packing according to my invention.

FIGS. 1, 3 and 4 show that the packing bars 1' are assembled in different arrangements into a supporting framework S. The supporting framework S has at leat one open frame area O.

In the embodiment according to FIGS. 1 and 2 the structure is such that the packing bars 1' are combined in a nearly planar supporting framework S. It may be used as a tray packing.

In the embodiments according to FIGS. 3 and 4 the supporting framework S has a larger size than that shown in FIG. 1. The packing bars 1' are assembled in a more spacious, three-dimensional supporting framework S. Simultaneously as was shown in FIG. 3 an open area and/or the open areas O of the supporting framework S can be covered by one or more packing panels 2'. The supporting framework S can also be reinforced by stabilizing pieces which can be connected to the packing bars 1'. In FIG. 4 one such stabilizing piece 4 is indicated by a diagonal dot-dashed line.

In the embodiment according to FIGS. 1 and 3 the packing bars 1' are provided in the vicinity of the frame corners in so far as required with an adhesive web 5 and are attached together with adhesive.

In the embodiment according to FIG. 4 corner caps 6 are provided on the upper frame portion of the supporting framework S each of which is triangular. One can use both the above described reinforcement using adhesive and the mounting of the corner caps 6 when special loads must be taken by the packing. The packing panels 2' can be glued on the supporting framework S and then additionally reinforced.

In a particularly advantageous embodiment of the invention the packing bars 1' are paper blanks which are folded angularly. It can be inferred from FIGS. 3 and 4 that they can be made from a plastic material.

The packing panels 2' can also be constructed from paper blanks. As is indicated in FIG. 3 one of the described pieces, namely the front packing panel 2', is formed as an a sign or code carrying element.

Figure 5:
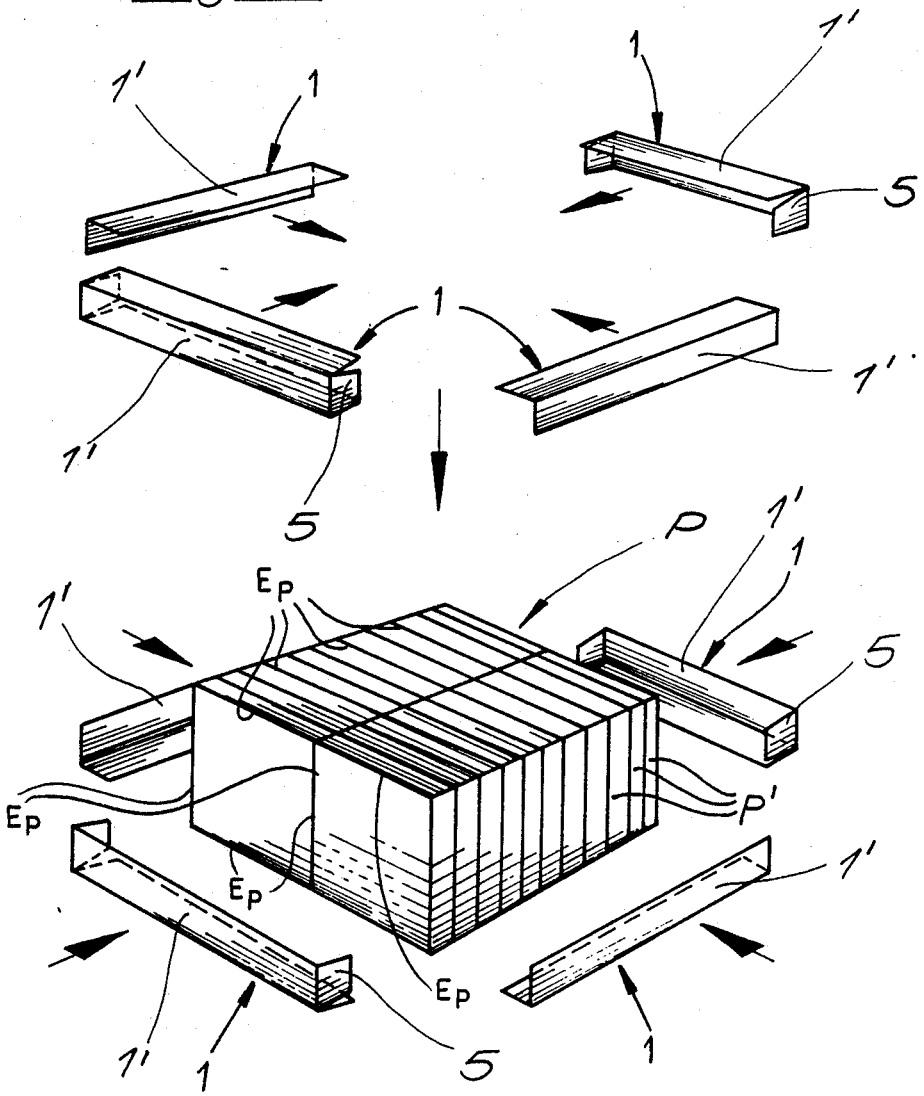
FIG. 5 is an exploded perspective view of packing pieces of a packing according to my invention before putting them on the stacked packaged goods.

FIG. 5 shows the situation during assembly of the packing from the packing bars 1' on the stacked packaged goods P. The packaged goods P consist of a plurality of individual packaged items or goods P' which have straight edges $E_p$.

Of course the packing bars or pieces with which the invention works can be manufactured by the roll, understandably using an appropriate tool for punching and folding. That can also happen at the location where they are put to use.

I claim:

1. A packing for packaged goods which goods have straight edges, said packing comprising:

a pair of first packing bars, each bar folded along a longitudinal direction thereof separating an upper from a lower area, said areas lying perpendicular to one another and being of equal length, and a pair of end flaps each hingedly attached to opposite ends of said upper area, each of said flaps folded to reside perpendicular to both said upper and lower areas;

a pair of second packing bars, each bar folded along a longitudinal direction thereof separating an upper from a lower area, said areas lying perpendicular to one another and being of equal length;

wherein said first and second pairs of packing bars are arranged into a supporting framework one type bar each alternating and connecting at right angles to one another, said end flaps each overlying a section of a respective upper area of said second packing bars, each of said lower areas of said second packing bars having portions at opposite ends thereof overlying respective portions of said lower areas of said first packing bars, and said supporting framework having at least one open frame area.

2. The packing defined in claim 1 wherein said packing bars are assembled in a substantially planar supporting framework.

3. The packing defined in claim 1 wherein said first pair of packing bars have at least one adhesive web in a vicinity of a corner of said supporting framework and said first and second packing bars are attached by adhesive with each other.

4. The packing defined in claim 1 wherein said packing bars are each made from a paper blank which is folded in an angular cross section.

5. The packing defined in claim 1 wherein at least one of said packing bars is made of a plastic material.

6. The packing defined in claim 1 wherein at least one of said packing bars which is essentially a packing panel of said packing is formed as a sign carrying element.

* * * * *